US006744993B2

(12) United States Patent
Takami

(10) Patent No.: US 6,744,993 B2
(45) Date of Patent: Jun. 1, 2004

(54) SHEET WINDING DETECTING DEVICE AND IMAGE FORMING APPARATUS

(75) Inventor: Hiroshi Takami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/126,689

(22) Filed: Apr. 22, 2002

(65) Prior Publication Data

US 2002/0164171 A1 Nov. 7, 2002

(30) Foreign Application Priority Data

Apr. 24, 2001 (JP) ..... 2001-125883

(51) Int. Cl.[7] ..... G03G 15/00; G03G 15/20
(52) U.S. Cl. ..... 399/22; 399/323
(58) Field of Search ..... 399/9, 16, 18, 399/21, 22, 67, 68, 322, 323, 398; 347/156

(56) References Cited

U.S. PATENT DOCUMENTS

| | | | | | |
|---|---|---|---|---|---|
| 3,650,616 | A | * | 3/1972 | Hudson | 399/22 |
| 3,650,619 | A | * | 3/1972 | Parker | 399/22 |
| 4,073,585 | A | * | 2/1978 | Kobayashi et al. | 399/22 |
| 4,239,372 | A | * | 12/1980 | Iwai | 399/22 |
| 4,512,649 | A | * | 4/1985 | Derimiggio | 399/22 |
| 5,365,322 | A | * | 11/1994 | Hamada et al. | 399/21 |
| 5,404,200 | A | * | 4/1995 | Martin et al. | 399/68 |
| 5,406,354 | A | * | 4/1995 | Taki et al. | 399/22 |
| 6,021,285 | A | * | 2/2000 | Mestha et al. | 399/9 |
| 6,026,257 | A | | 2/2000 | Takami et al. | 399/66 |
| 6,438,348 | B2 | | 8/2002 | Kobaru et al. | 399/333 |
| 6,496,661 | B2 | | 12/2002 | Ando et al. | 399/22 |

FOREIGN PATENT DOCUMENTS

| | | | |
|---|---|---|---|
| JP | 11-038817 | * | 2/1999 |
| JP | 2000-255835 | | 9/2000 |

* cited by examiner

*Primary Examiner*—Sandra Brase
(74) *Attorney, Agent, or Firm*—Fitzpatrick, Cella, Harper & Scinto

(57) ABSTRACT

An image forming apparatus is provided which is capable of reliably preventing a recording sheet wound around a roller member from being further wound around the roller member even when the power supply of the image forming apparatus is turned on/off while the recording sheet is wound around the roller member. A high voltage power supply section applies voltage to feeding brushes disposed in contact with the surface of a pressurizing roller having an electrically conductive surface. A winding sensor is disposed in contact with the surface of the pressurizing roller and is located in a sheet passing area of the pressurizing roller. A CPU provides control such that the pressurizing roller is inhibited from being driven when it determines that the recording sheet is caught between the pressurizing roller and the winding sensor according the result of comparison between the output voltage from the winding sensor and detected voltage of the feeding brushes.

22 Claims, 10 Drawing Sheets

SHEET WINDING DETECTING DEVICE AND IMAGE FORMING APPARATUS

BACKGROUND OF THE INVENTION

1. Field of the Invention

The present invention relates to a sheet winding detecting device and an image forming apparatus, and more particularly to a sheet winding detecting device and an image forming apparatus that can be suitably used to detect winding of a recording sheet around a roller member such as a pressurizing roller and a fixing roller in the image forming apparatus using a thermal fixing device.

2. Description of the Related Art

There is widely used an image forming apparatus which transfers a toner image formed on a photosensitive drum onto a recording sheet, and thermally fixes the toner image on the recording sheet by a thermal fixing device having roller members such as a fixing roller and a pressurizing roller to form an image on the recording sheet. Such an image forming apparatus using a thermal fixing device separates a recording sheet bearing a fixed toner image from a roller member such as a fixing roller or a pressurizing roller by separating means such as separation pawls. If toner or stain adheres to the roller member, however, the recording sheet cannot be separated from the roller member, and this may result in winding of the recording sheet around the roller member.

Further, when an operator turns on/off a power supply of the image forming apparatus while the recording sheet is wound around the roller member, if the recording sheet wound around the roller member cannot be detected, the roller member is driven although the recording sheet is wound around the roller member. This causes the recording sheet to be further wound around the roller member.

Therefore, a sheet winding detecting device and an image forming apparatus are demanded, which reliably prevent a recording sheet from being wound around a roller member.

SUMMARY OF THE INVENTION

It is therefore an object of the present invention to provide a sheet winding detecting device and an image forming apparatus that are capable of reliably preventing a sheet wound around a conveying means that conveys the sheet from being further wound around the conveying means.

To attain the above object, in a first aspect of the present invention, there is provided a sheet winding detecting device comprising conveying means for conveying a sheet while rotating, voltage applying means for applying voltage to the conveying means, voltage detecting means for detecting voltage related to the conveying means, sheet winding detecting means for detecting whether the sheet is wound around the conveying means according to the voltage detected by the voltage detecting means, and function status detecting means for detecting whether the sheet winding detecting means is malfunctioning.

Preferably, when the function status checking means detects that the sheet winding detecting means is not malfunctioning, the voltage applying means applies voltage to the conveying means, and the sheet winding detecting means detects whether the sheet is wound around the conveying means according to the voltage applied by the voltage applying means and the detected voltage.

Preferably, the sheet winding detecting device according to the first aspect comprises control means for controlling the conveying means, and the control means controls the conveying means such that the sheet is inhibited from being conveyed when the sheet winding detecting means detects that the sheet is wound around the conveying means.

More preferably, when the function status detecting means detects that the sheet winding detecting means is malfunctioning, the voltage applying means omits to apply voltage to the conveying means.

Yet more preferably, the control means controls the conveying means such that the sheet is inhibited from being conveyed when the function status detecting means detects that the sheet winding detecting means is malfunctioning.

Alternatively, the control means controls the conveying means such that the sheet is allowed to be conveyed when the function status detecting means detects that the sheet winding detecting means is malfunctioning.

Also preferably, the sheet winding detecting device according to the first aspect comprises setting means for setting the sheet to be conveyed or to be inhibited from being conveyed when the function status detecting means detects that the sheet winding detecting means is malfunctioning, and the control means controls the conveying means according to the setting by the setting means when the function status detecting means detects that the sheet winding detecting means is malfunctioning.

In a preferred form, the conveying means has a pair of rollers that convey the sheet interposed therebetween, and the sheet winding detecting means detects whether the sheet is wound around at least one of the rollers.

Preferably, the function status detecting means is responsive to turning-on of power supply of the sheet winding detecting device, for detecting whether the sheet winding detecting means is malfunctioning.

To attain the above object, in a second aspect of the present invention, there is provided an image forming apparatus that forms an image on a recording sheet, comprising conveying means for conveying the recording sheet while rotating, the conveying means having a sheet passing area, voltage applying means for applying voltage to the conveying means, a conductive member disposed in the sheet passing area of the conveying means, voltage detecting means for detecting voltage related to the conveying means via the conductive member, holding means for holding the conductive member in contact or non-contact with the sheet passing area of the conveying means, recording sheet winding detecting means for detecting whether the recording sheet is wound around the conveying means according to the voltage applied by the voltage applying means and the voltage detected by the voltage detecting means when the conductive member is held in contact with the sheet passing area of the conveying means, and function status detecting means for detecting whether the recording sheet winding detecting means is malfunctioning.

Preferably, the function status detecting means detects whether the recording sheet winding detecting means is malfunctioning when the holding means holds the conductive member in non-contact with the sheet passing area of the conveying means.

Preferably, the image forming apparatus according to the second aspect comprises control means for controlling the conveying means, and the control means controls the conveying means such that the recording sheet is inhibited from being conveyed when the recording sheet winding detecting means detects that the recording sheet is wound around the conveying means.

More preferably, the control means controls the conveying means such that the recording sheet is inhibited from being conveyed when the function status detecting means detects that the recording sheet winding detecting means is malfunctioning.

Alternatively, the control means controls the conveying means such that the recording sheet is allowed to be conveyed when the function status detecting means detects that the recording sheet winding detecting means is malfunctioning.

Preferably, the image forming apparatus according to the second aspect comprises setting means for setting the recording sheet to be conveyed or to be inhibited from being conveyed when the function status detecting means detects that the recording sheet winding detecting means is malfunctioning, and wherein the control means controls the conveying means according to the setting by the setting means when the function status detecting means detects that the recording sheet winding detecting means is malfunctioning.

Preferably, the voltage applying means stops application of voltage when the holding means is switched between a state in which the conductive member is in contact with the sheet passing area of the conveying means and a state in which the conductive member is in non-contact with the sheet passing area of the conveying means.

Also preferably, the function status detecting means is responsive to turning-on of power supply of the image forming apparatus, for detecting whether the recording sheet winding detecting means is malfunctioning.

To attain the above object, in a third aspect of the present invention, there is provided an image forming apparatus that forms an image on a recording sheet, comprising fixing means for fixing a toner image formed on the recording sheet bearing the toner image while conveying the recording sheet, the fixing means having a rotatable member having a sheet passing area and disposed in contact with a reverse side of the recording sheet bearing the toner image, voltage applying means for applying voltage reverse in polarity to toner to the rotatable member, voltage detecting means for detecting voltage related to the rotatable member in the sheet passing area of the rotatable member, and recording sheet winding detecting means for detecting whether the recording sheet is wound around the rotatable member according to the voltage detected by the voltage detecting means.

Preferably, the image forming apparatus according to the third aspect comprises control means for controlling the fixing means, and wherein the control means controls the fixing means such that the recording sheet is inhibited from being conveyed when the recording sheet winding detecting means detects that the recording sheet is wound around the rotatable member.

Also preferably, the recording sheet winding detecting means is responsive to turning-on of power supply of the image forming apparatus, for detecting whether the recording sheet is wound around the rotatable member.

The above and other objects, features, and advantages of the invention will become more apparent from the following detailed description taken in conjunction with the following drawings.

DETAILED DESCRIPTION OF THE PREFERRED EMBODIMENTS

The present invention will now be described in detail with reference to the drawings showing preferred embodiments thereof.

Figure 1:
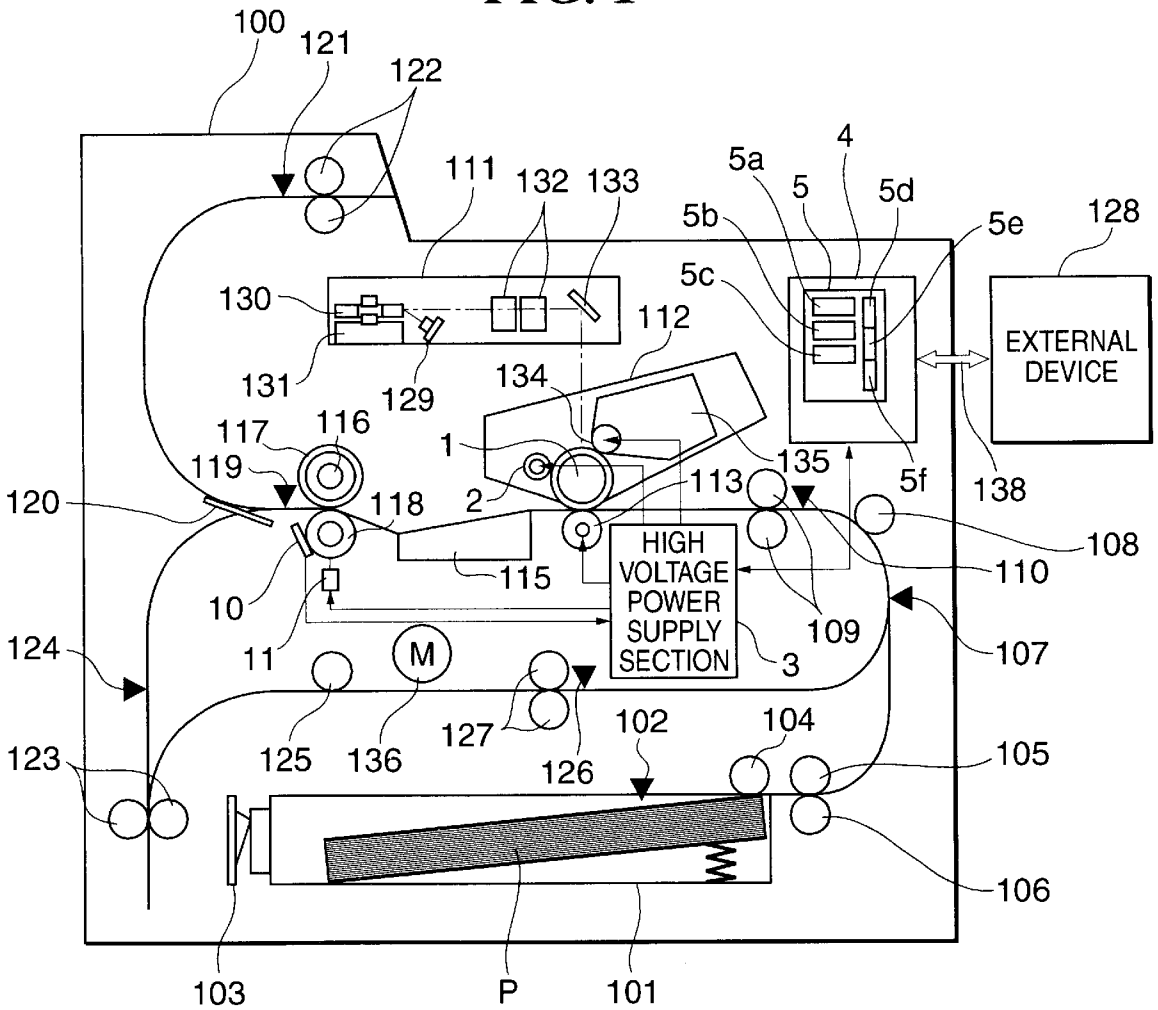
FIG. 1 is a diagram showing the internal construction of a laser beam printer as an image forming apparatus according to any of first to third embodiments of the present invention.
Figure 2:
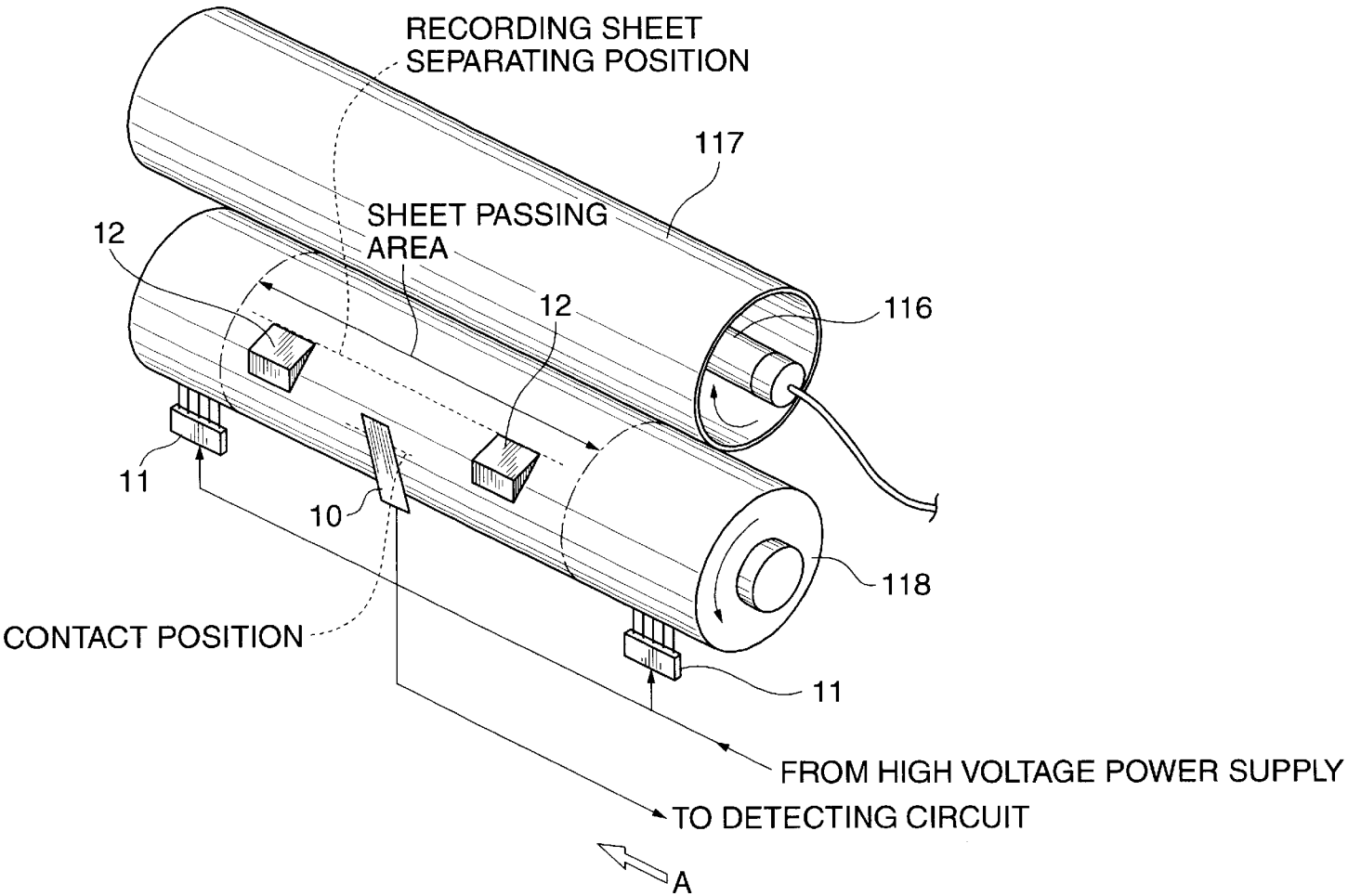
FIG. 2 is a perspective view showing the arrangement of a winding sensor and its related parts with respect to a pressurizing roller in the laser beam printer in FIG. 1.
Figure 3:
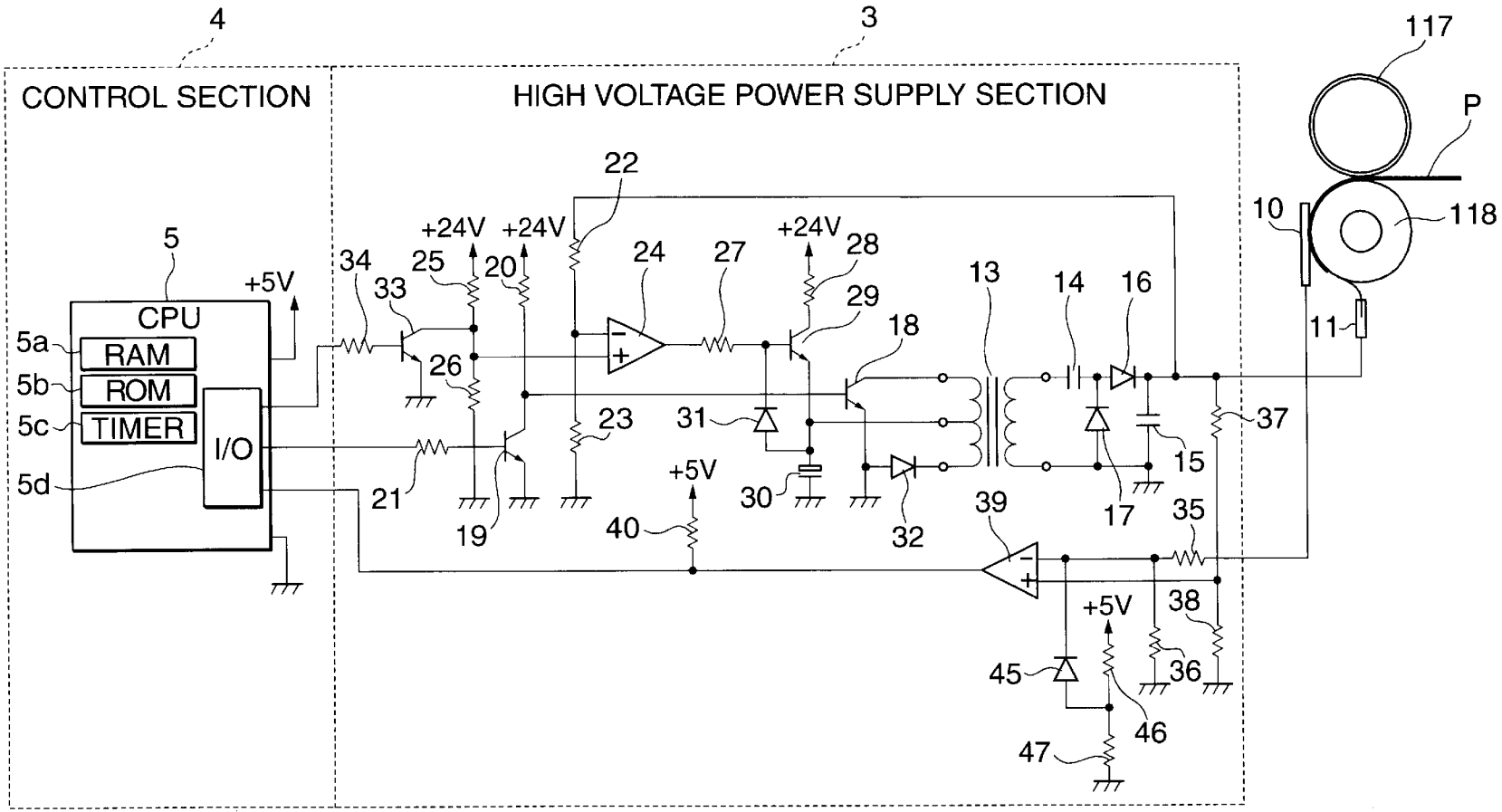
FIG. 3 is a circuit diagram showing the configuration of a recording sheet winding detecting circuit in the laser beam printer in FIG. 1.
Figure 4:
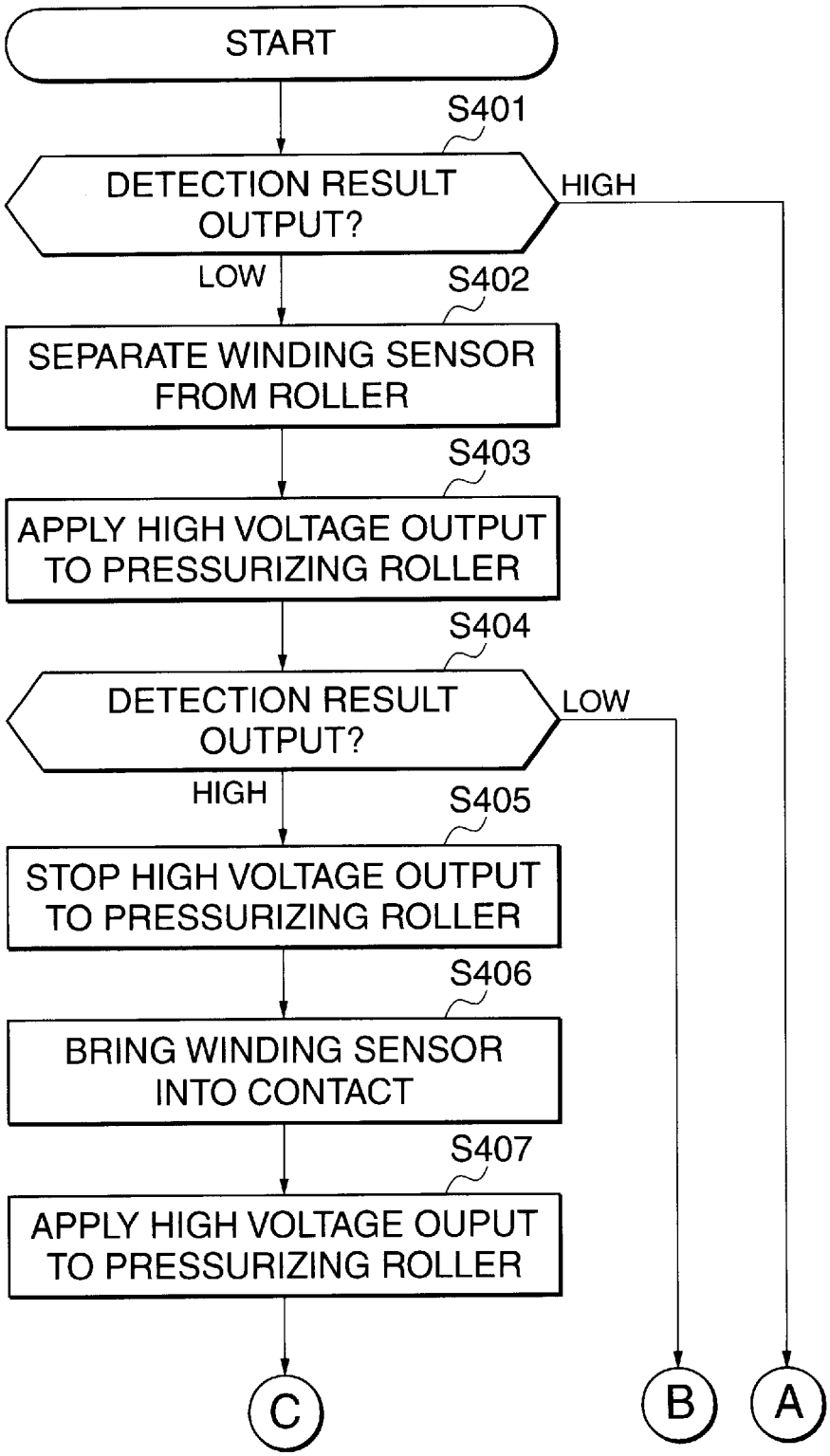
FIG. 4 is a flow chart showing a recording sheet winding detecting process according to the first embodiment of the present invention.
Figure 5:
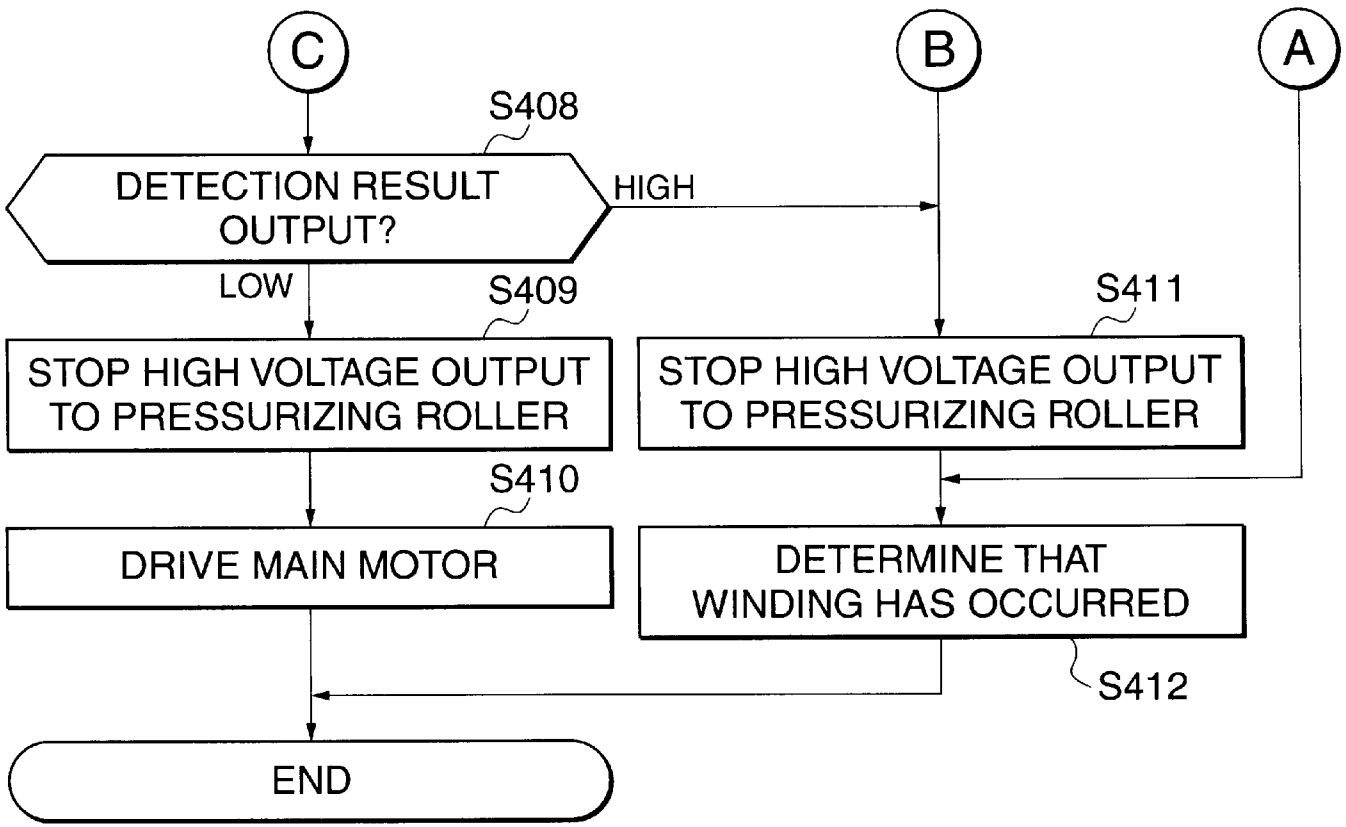
FIG. 5 is a flow chart showing a continued part of the recording sheet winding detecting process in FIG. 4.
Figure 6A:
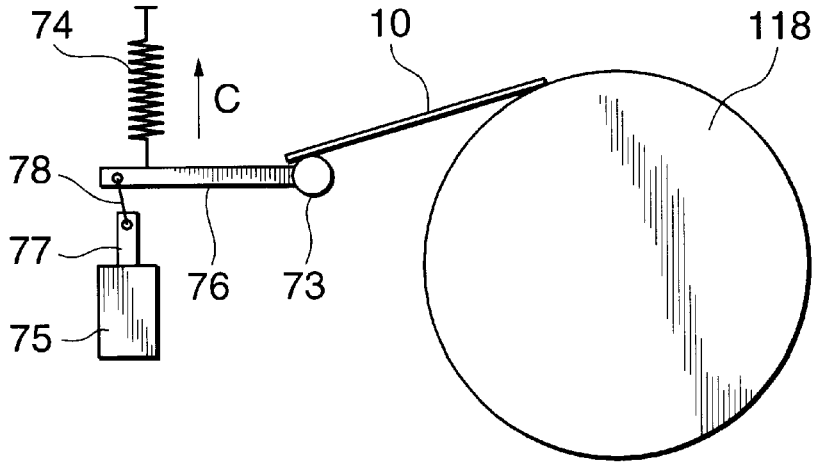
FIG. 6A is a diagram showing the arrangement of a separation mechanism in a state in which the winding sensor of the laser beam printer in FIG. 1 is in contact with the surface of the pressurizing roller.
Figure 6B:
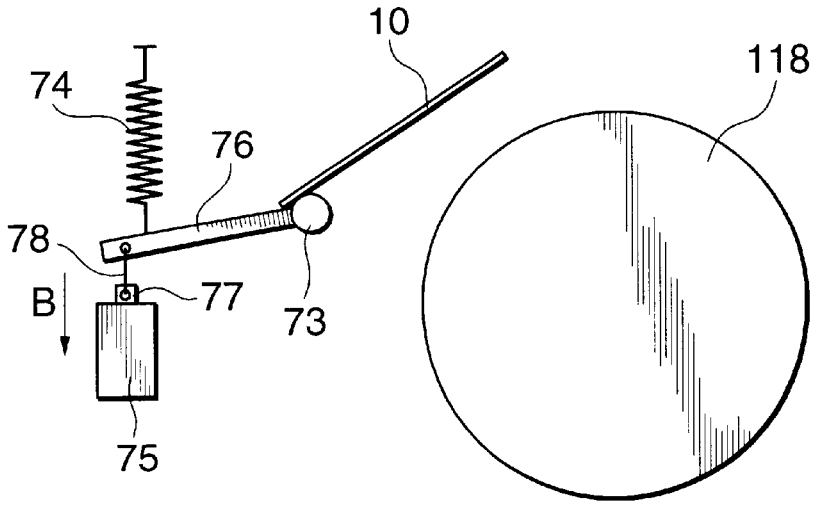
FIG. 6B is a diagram showing the arrangement of the separation mechanism in a state in which the winding sensor is not in contact with the surface of the pressurizing roller.

FIG. 1 is a diagram showing the internal construction of a laser beam printer as an image forming apparatus according to any of first to third embodiments of the present invention, FIG. 2 is a perspective view showing the arrangement of a winding sensor and its related parts with respect to a pressurizing roller in the laser beam printer in FIG. 1, FIG. 3 is a circuit diagram showing the configuration of a recording sheet winding detecting circuit in the laser beam printer in FIG. 1, FIG. 4 is a flow chart showing a recording sheet winding detecting process according to the first embodiment, FIG. 5 is a flow chart showing a continued part of the recording sheet winding detecting process in FIG. 4, FIG. 6A is a diagram showing the arrangement of a separation mechanism in a state in which a winding sensor of the laser beam printer in FIG. 1 is in contact with the surface of the pressurizing roller, and FIG. 6B is a diagram showing the arrangement of the separation mechanism in a state in which the winding sensor is not in contact with the surface of the pressurizing roller.

As shown in FIG. 1, the laser beam printer 100 is comprised of a high voltage power supply section 3, a printer control section 4, a winding sensor 10, feeding (conductive) brushes 11, a deck 101, a deck sheet presence sensor 102, a sheet size sensor 103, a pickup roller 104, a deck sheet feeding roller 105, a retard roller 106, a sheet feed sensor 107, a sheet feeding and conveying roller 108, a pair of resist rollers 109, a pre-resist sensor 110, a laser scanner section 111, a process cartridge 112, a roller member 113, a conveying guide 115, a halogen heater 116, a fixing roller 117, a pressurizing roller 118, a fixed sheet discharge sensor 119, a duplex flapper 120, a sheet discharge sensor 121, a pair of sheet discharge rollers 122, a pair of inversion rollers

123, an inversion sensor 124, a D-cut roller 125, a duplex sensor 126, a pair of duplex conveying rollers 127, a main motor 136, and an interface 138. In FIG. 1, reference numeral 128 denotes an external device or apparatus.

In further detail, the deck 101 stores a recording sheet P, the deck sheet presence sensor 102 detects whether or not the recording sheet P is stored in the deck 101, the sheet size sensor 103 detects the size of the recording sheet P stored in the deck 101, the pickup roller 104 feeds the recording sheet P from the deck 101, the deck sheet feeding roller 105 conveys the recording sheet P fed by the pickup roller 104, and the retard roller 106 which is paired with the deck sheet feeding roller 105 is intended to prevent simultaneous feeding of two or more recording sheets P.

Further, the deck 101, the sheet discharge sensor 107 that detects the conveyance condition of the recording sheet P fed from a duplex inverting section that will be described later, the sheet feeding and conveying roller 108 that conveys the recording sheet P further downstream, the pair of resist rollers 109 that convey the recording sheet in synchronism with each other, and the pre-resist sensor 110 that detects the conveyance condition of the recording sheet P conveyed to the pair of resist rollers 109 are arranged downstream of the deck sheet feeding roller 105.

Further, the process cartridge 112 that forms a toner image on a photosensitive drum 1 according to laser light from the laser scanner section 111 that will be described later, and the roller member 113 that transfers the toner image formed on the photosensitive drum 1 onto the recording sheet P (hereinafter referred to as "transfer roller") are arranged downstream of the pair of resist rollers 109.

Further, arranged downstream of the transfer roller 113 are the conveyance guide 115 that guides the recording sheet P during conveyance thereof; the pair of rollers comprised of the fixing roller 117 that includes the halogen heater 116 for heating so as to thermally fix a toner image transferred onto the recording sheet P, and the pressurizing roller 118 that has an electrically conductive surface to pressurize the recording sheet P against the fixing roller 117; the feeding brushes 11 that apply a high voltage the surface of the pressurizing roller 118; the winding sensor 10 as an electrically conductive member that detects winding of the recording sheet P around the pressurizing roller 118; the fixed sheet discharge sensor 119 that detects the conveyance condition of the recording sheet P conveyed from a fixing section; and the duplex flapper 120 that switches the destination of the recording sheet P conveyed from the fixing section between a sheet discharge section and a duplex inverting section. Further, downstream of the duplex flapper 120, the sheet discharge sensor 121 that detects the conveyance condition of the recording sheet in a sheet discharge section, and the pair of sheet discharge rollers 122 that discharge the recording sheet are arranged in the sheet discharge section.

On the other hand, in the duplex inverting section that turns the recording sheet upside down after simplex printing in order to print images on both sides of the recording sheet P and feeds the recording sheet P again to an image forming section, there are provided the pair of inversion rollers 123 that switch the path of the recording sheet P backward by reverse rotation, the inversion detecting sensor 124 that detects the conveyance condition of the recording sheet P conveyed to the inversion rollers 123, the D-cut roller 125 that conveys the recording sheet P from a transverse-direction registration section (not illustrated) that aligns the recording sheet P in the transverse direction, the duplex sensor 126 that detects the conveyance condition of the recording sheet P conveyed in the duplex inverting section, and the pair of duplex conveying rollers 127 that convey the recording sheet P from the duplex inverting section to the sheet feeding section.

Further, the scanner section 111 is comprised of a laser unit 129 that emits a laser light modulated according to an image signal transmitted from the external device 128 to the laser beam printer 100, a polygon mirror 130 that scans an image on the photosensitive drum 1 with the laser light emitted from the laser unit 129, a scanner motor 131 that rotates the polygon mirror 130, an image formation lens group 132 that guides the laser light reflected on the polygon mirror 130, and a reflex mirror 133 that reflects the laser light guided by the image formation lens group 132 toward the photosensitive drum 1.

Further, the process cartridge 112 is comprised of the photosensitive drum 1 on which a toner image is to be formed, an electrifying roller 2 that electrifies the photosensitive drum 1, a developing blade 134 that is used for development, a toner container 135 that contains toner, and others, which are required for a known electrophotographing process. The process cartridge 112 is detachable from the frame of the laser printer 100.

The high voltage power supply section 3 is comprised of the electrifying roller 2, the developing blade 134, and a high voltage circuit that feeds a desired voltage to the transfer roller 113, in addition to a pressurizing roller high voltage circuit that will be described later. The main motor 136 supplies power to various sections of the image forming apparatus 100, such as the pressurizing roller 113. Incidentally, although a drive source for driving the pressurizing roller 118 may be either the main motor that supplies power to various sections of the image forming apparatus 100 or a motor that is provided for exclusive use in driving the pressurizing roller 118, the following description of the present embodiment assumes that the main motor 136 drives the pressurizing roller 118.

The printer control section 4 is used to control various sections of the laser beam printer 100. The printer control section 4 is comprised of a CPU 5 that is formed by an MPU (microcomputer) including a RAM 5*a*, ROM 5*b*, timer 5*c*, digital input/output ports (hereinafter referred to as "the I/O port") 5*d*, analog-to-digital conversion input ports 5*e* (hereinafter referred to as "the A/D input port), and digital-to-analog conversion output ports 5*f* (hereinafter referred to as "the D/A output port"), a variety of input/output control circuits that are not illustrated, and others. The printer control circuit 4 is connected to the external device 128, which may be a personal computer, via the interface 138.

Figure 7:
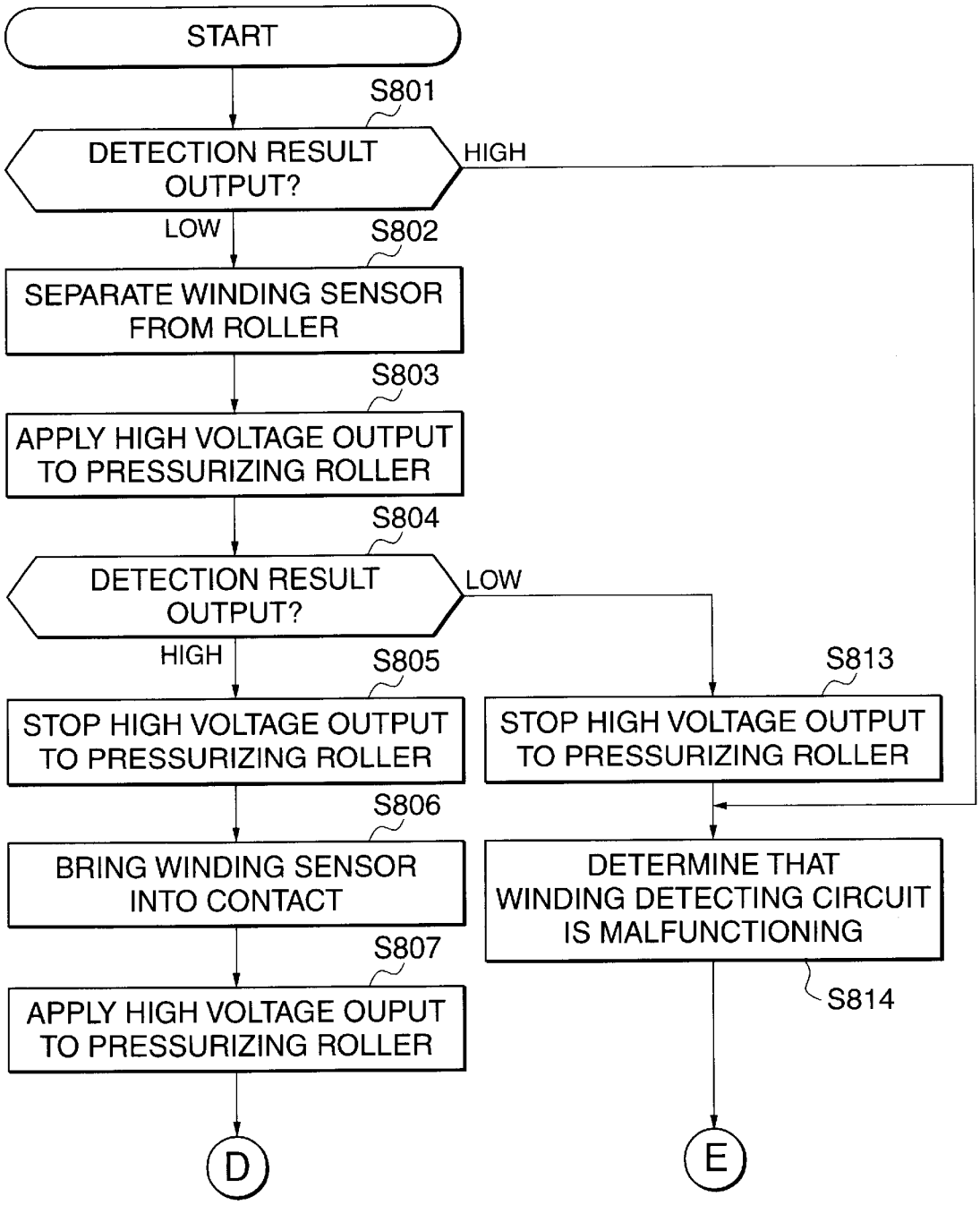
FIG. 7 is a flow chart showing a recording sheet winding detecting circuit condition checking process according to the second embodiment of the present invention.
Figure 8:
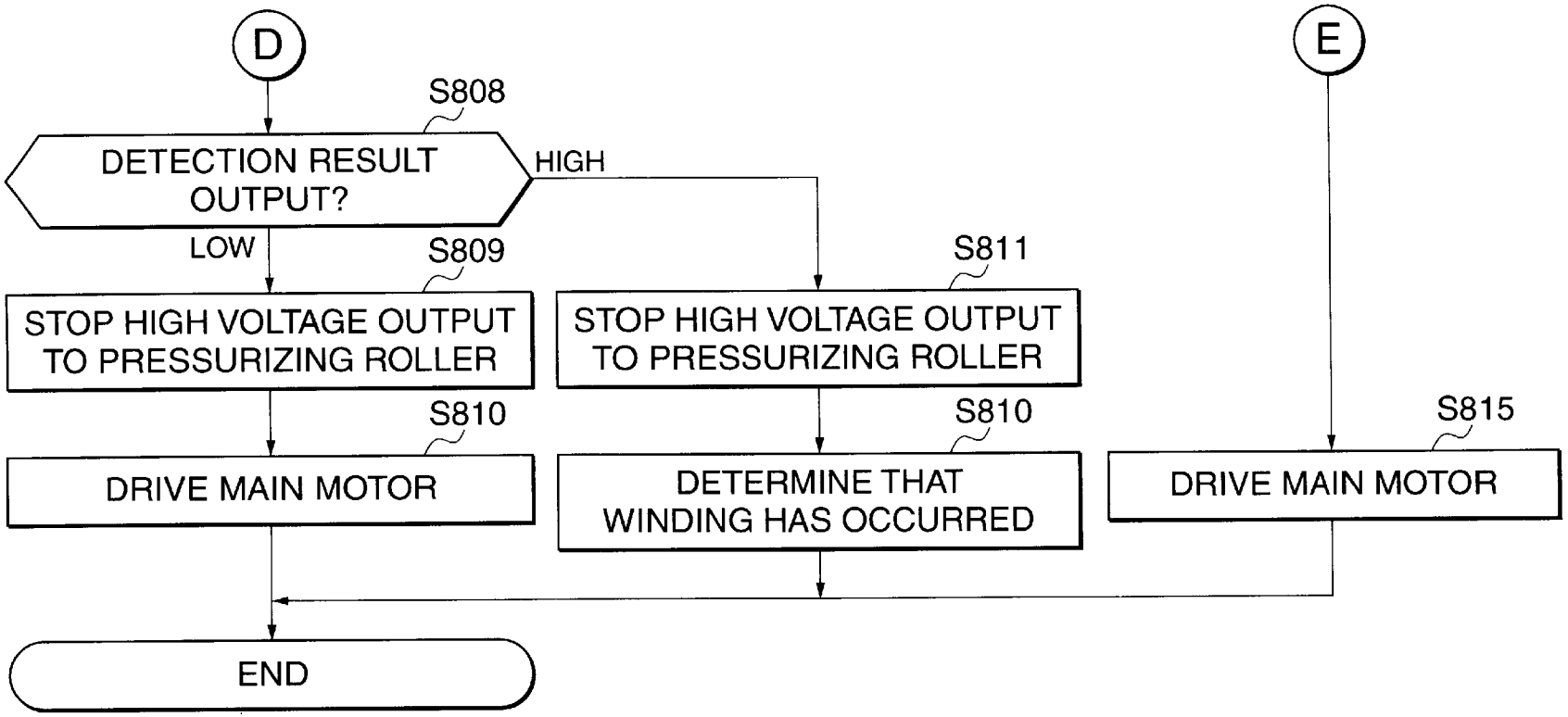
FIG. 8 is a flow chart showing a continued part of the recording sheet winding detecting circuit condition checking process in FIG. 7.
Figure 9:
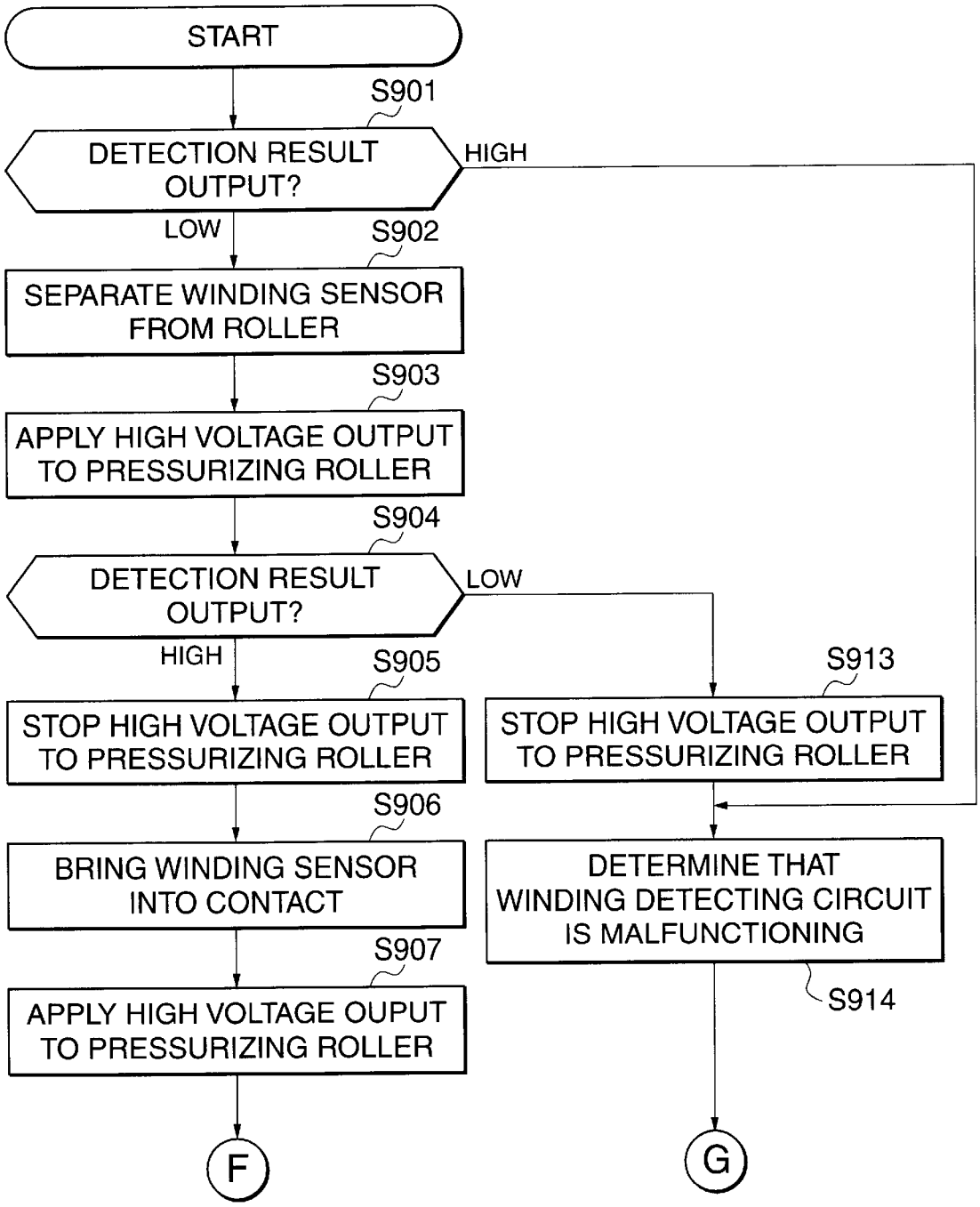
FIG. 9 is a flow chart showing a recording sheet winding detecting circuit condition checking process according to the third embodiment of the present invention.
Figure 10:
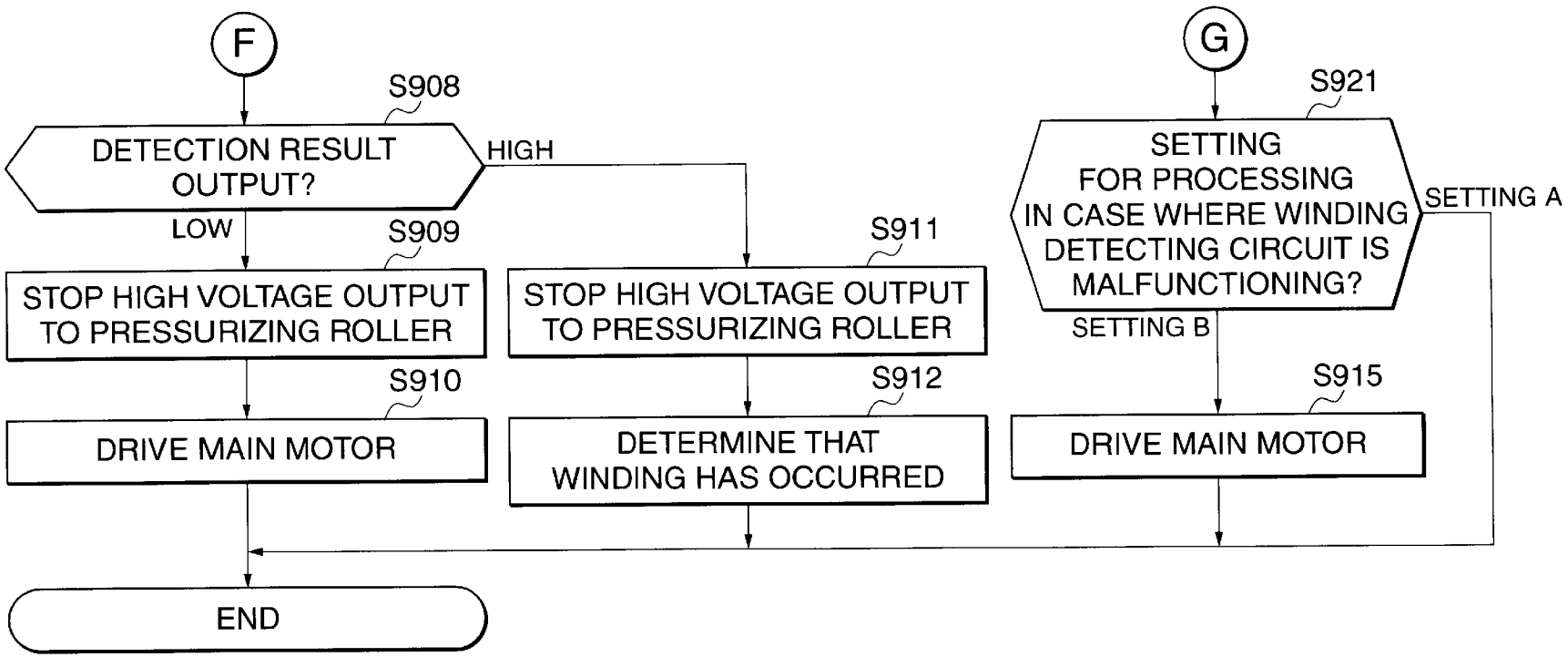
FIG. 10 is a flow chart showing a continued part of the recording sheet winding detecting circuit condition checking process in FIG. 9.

The CPU 5 of the printer control section 4 controls various sections of the image forming apparatus 100, and carries out a process as shown in the flow charts of FIGS. 4 and 5 (first embodiment), FIGS. 7 and 8 (second embodiment), or FIGS. 9 and 10 (third embodiment), according to a program stored in the ROM 5*b*. The RAM 5*a* is a memory that serves as a working area for the CPU 5 and a temporary storage area. The ROM 5*b* is a memory that stores programs to be executed by the CPU 5. The timer 5*c* measures elapsed time. The I/O port 5*d* inputs and outputs digital signals. The A/D input port 5*e* convents input analog signals to digital signals. The D/A output port 5*f* converts digital signals to analog signals and outputs the same.

FIG. 2 is a perspective view showing the arrangement of the winding sensor 10 and its related parts with respect to the pressuring roller 118 of the laser beam printer in FIG. 1. The fixing roller 117 and the pressurizing roller 118 are opposed to each other such that the respective outer peripheral surfaces thereof are held in partial contact with each other in the axial direction, and they are driven to rotate in respective directions indicated by arrows in FIG. 2. The fixing roller 117 is shaped like a cylinder, and the halogen heater 116 is disposed in the axial direction in the fixing roller 117. Separation pawls 12 serving as a separation mechanism for separating the recording sheet P from the pressurizing roller 118 are disposed in proximity to the pressurizing roller 118.

The winding sensor 10 is disposed in contact with the surface of the pressurizing roller 118 at a location within a sheet passing area of the pressurizing roller 118 and between the separation pawls 12 and a roller nip portion (i.e. an area between the pressurizing roller 118 and the fixing roller 117) which is located downstream of the separation pawls 12 in the rotating direction of the pressurizing roller 118. In the illustrated embodiment, the winding sensor 10 is designed to be separable from the pressurizing roller 118, and a separation mechanism therefor will be described later in detail with reference to FIG. 7. The feeding brushes 11 for feeding a high voltage to the surface of the pressurizing roller 118 are disposed respectively at both ends of the pressurizing roller 118 in the longitudinal direction. An output from the winding sensor 10 is inputted to a winding detecting circuit that will be described later, and the high voltage power supply section 3 supplies a high voltage to the feeding brushes 11. In FIG. 2, a range indicated by a double-headed arrow is the sheet passing area, a broken line along the separation pawls 12 indicates a recording sheet separating position, and a broken line in proximity to the winding sensor 10 indicates a contact position.

FIG. 6A shows the arrangement of the separation mechanism in the state in which the winding sensor 10 of the laser beam printer in FIG. 1 is in contact with the surface of the pressurizing roller 118, and FIG. 6B shows the arrangement of the separation mechanism in the state in which the winding sensor 10 is not in contact with the surface of the pressurizing roller 118. FIGS. 6A and 6B show the separation mechanism viewed from a direction indicated by an arrow A in FIG. 2.

The winding sensor 10 is fixed to a rotary shaft 73, and is rotatable about the rotary shaft 73 in the clockwise and counterclockwise directions in FIGS. 6A and 6B. The rotary shaft 73 is connected to a spring 74 via a member 76, and is connected to a moving part 77 of an electromagnetic solenoid 75 via the member 76 and a member 78. The position of the winding sensor 10 depends on the driving condition of the electromagnetic solenoid 75.

FIG. 6A shows the state in which the electromagnetic solenoid 75 is OFF. On this occasion, the moving part 77 of the electromagnetic solenoid 75 is can freely move, and the application of a force from the spring 74 to the moving part 77 in a direction indicated by an arrow C brings the winding sensor 10 into contact with the surface of the pressurizing roller 118. The contact pressure of the winding sensor 10 against the pressurizing roller 118 is determined by the setting load of the spring 74. Setting the contact pressure to 100 gf or lower realizes a great difference in output voltage of the winding sensor 10 between the following two cases: the case where the recording sheet is caught between the winding sensor 10 and the pressurizing roller 118 and the case where no recording sheet is caught between the winding sensor 10 and the pressurizing roller 118. This prevents false detection.

On the other hand, FIG. 6B shows the state in which the electromagnetic solenoid 75 is ON. The moving part 77 of the electromagnetic solenoid 75 is pulled in a direction indicated by an arrow B, and this causes the winding sensor 10 to rotate about the rotary shaft 73 counterclockwise in the figure, so that the winding sensor 10 is brought into non-contact with the surface of the pressurizing roller 118.

FIG. 3 is a circuit diagram showing the configuration of a recording sheet winding detecting circuit of the laser beam printer 100 in FIG. 1. The recording sheet winding detecting circuit detects whether or not the recording sheet is wound around the pressurizing roller 118 according to the detected voltage from the winding sensor 10, and is comprised of various circuit elements including a comparator 39 that will be described later. In FIG. 3, reference numeral 13 denotes an inverter transformer. An output voltage generated across a secondary winding of the inverter transformer 13 is rectified (to about 300 volts, for example) by a voltage doubler rectifier circuit comprised of high voltage capacitors 14, 15 and high voltage diodes 16, 17, and is then applied to the feeding brushes 11.

It should be noted that the application of the high voltage to the pressurizing roller 118 aims at preventing so-called electrostatic offsetting. The electrostatic offsetting means a phenomenon that an electric field that draws the toner off from the recording sheet is generated due to friction between the recording sheet and the roller member, for example, to cause the toner to be transferred to the roller member when the recording sheet bearing a charged toner image passes the roller member. In this case, the toner transferred onto the roller member adheres to a recording sheet that is subsequently conveyed, and gives an adversary effect on the image. To prevent the electrostatic offsetting, the voltage is applied to the pressurizing roller 118 to generate an electric field that draws the toner to the recording sheet. In the present embodiment, positive voltage reverse in polarity to toner (negative polarity) is applied to the pressurizing roller 118 disposed in contact with a reverse side of the recording sheet bearing the toner image to generate an electric field that draws the toner to the recording sheet.

Further, at the primary side of the inverter transformer 13, a clock signal outputted from the I/O port 5*d* of the CPU 5 is turned on/ off via a base resistor 21 connected to a base of a small signal transistor 19, the small signal transistor 19, a pull-up resistor 20 connected to a collector of the small signal transistor 19, and a transistor 18. In order to control the output voltage of the inverter transformer 13 to a predetermined voltage (e.g. 300 volts), a voltage obtained by dividing the output voltage by resistors 22, 23 is inputted to an inverting input terminal of an operational amplifier 24, and a reference voltage obtained by dividing a power supply voltage+24V by resistors 25, 26 is inputted to a non-inverting input terminal of the operational amplifier 24, and an output from the operational amplifier 24 is supplied to the inverter transformer 13 via a transformer drive circuit comprised of a transistor 29 and an aluminium electrolytic capacitor 30 whereby the input voltage of the inverter transformer 13 is regulated.

The diode 31 is a protective diode that protects the transistor 29, and the diode 32 is used to allow flyback current to flow to the inverter transformer 13. Further, a signal from the I/O port 5*d* of the CPU 5 causes a transistor 33 to be turned on via a resistor 34 to cause the non-inverting input terminal of the operational amplifier 24 to be shorted to ground via the transistor 33 so that the reference voltage can be 0 volts and hence a high voltage output can be turned off.

On the other hand, the output voltage from the winding sensor 10 is divided by resistors 35, 36 and the divided voltage is inputted to an inverting input terminal of the comparator 39, and a high output voltage from the inverter transformer 13 is divided by resistors 37, 38 and the divided voltage is inputted to a non-inverting input terminal of the comparator 39. The respective resistance values of these resistors are determined such that a non-inverting input terminal voltage of the comparator 39 is greater than an inverting input terminal voltage thereof and the output voltage from the comparator 39 becomes high via a pull-up resistor 40 when the output voltage from the winding sensor 10 becomes equal to or smaller than a predetermined percentage (e.g. 85%) of the high output voltage.

A voltage obtained by dividing the power supply voltage 5V by resistors 46 and 47 is applied to the inverting input terminal of the comparator 39 via a diode 45. The voltage division values, i.e. relative resistance values of the resistors 46 and 47 are set so as to provide a voltage corresponding to a predetermined percentage (e.g. 10%) of the voltage that is inputted to the non-inverting input terminal of the comparator 39 when the high output voltage is outputted. An output terminal of the comparator 39 is connected to an input terminal of the I/O port 5*d*. This enables the CPU 5 to detect the presence of the recording sheet P caught between the pressurizing roller 118 and the winging sensor 10.

Referring next to the flow charts of FIGS. 4 and 5, a detailed description will be given of a recording sheet winding detecting process carried out by the image forming apparatus according to the first embodiment of the present invention, which is constructed as described above. The CPU 5 of the printer control section 4 in the image forming apparatus 4 executes the flow of operations described with reference to the flow charts of FIGS. 4 and 5 according to a program.

Upon start of an image forming process by the image forming apparatus, which is triggered when the power supply of the image forming apparatus is turned on or when a door of the apparatus is opened to cope with sticking of paper and the door is then closed, in a step S401 the CPU 5 of the printer control section 4 reads in the condition of the I/O port 5*d* to check the results of detection outputted from the recording sheet winding detecting circuit. At the start of the image forming process by the image forming apparatus, the output from the comparator 39 is stalled since no high voltage output is then applied from the high voltage power supply section 3 to the pressurizing roller 118. That is, since voltage input to the inverting input terminal (hereinafter referred to as "the negative input") of the comparator 39 is equal to the divided voltage obtained by the resistors 46 and 47 and voltage input to the non-inverting input terminal (hereinafter referred to as "the positive input") of the comparator 39 is equal to the GND level, the output from the comparator 39 is low, i.e. the detection result shows a normal state.

If the output from the comparator 39 is high in the step S401, it is determined that the recording sheet winding detecting circuit is malfunctioning and that it is therefore impossible to properly detect whether or not the recording sheet is wound on the pressurizing roller 118. It is then determined in a step S412 that the winding of the recording sheet around the pressurizing roller 118 has occurred, and the subsequent printing process is not carried out.

On the other hand, if the comparator output is low in the step S401, the winding sensor 10 is brought into non-contact with the pressurizing roller 118 by driving the electromagnetic solenoid 74 in a step S402. Then, in a step S403, a high voltage output is applied from the high voltage power supply section 3 to the pressurizing roller 118, and in a step S404, the detection result output from the recording sheet winding detecting circuit is checked again. The positive input of the comparator 39 during the application of the high voltage output to the pressurizing roller 118 is equal to the voltage obtained by dividing the high voltage output from the high voltage power supply section 3 to the pressurizing roller 118 by the resistors 37 and 38, and the negative input of the comparator 39 is equal to the voltage obtained by dividing the power supply voltage 5V by the resistors 46 and 47. Thus, the output from the comparator 39 is high, i.e. the detection result output shows a normal state.

If the detection result output is low in the step S404, it is determined that the recording sheet winding detecting circuit is malfunctioning and that it is therefore impossible to properly detect whether or not the recording sheet is wound around the pressurizing roller 118. Then, in a step S411, the application of the high voltage output from the high voltage power supply section 3 to the pressurizing roller 118 is stopped, and it is then determined in the step S412 that the winding of the recording sheet around the pressurizing roller 118 has occurred. The subsequent printing process is not carried out.

On the other hand, if the detection result output is high in the step S404, the application of the high voltage output from the high voltage power supply section 3 to the pressurizing roller 118 is stopped once in a step S405, and the winding sensor 10 is brought into contact with the pressurizing roller 118 by driving the electromagnetic solenoid 75 in a step S406. In a step S407, the high voltage output is applied again from the high voltage power supply section 3 to the pressurizing roller 118. The reason why the high voltage output is applied to the pressurizing roller 118 in the step S405 is to prevent discharge between the winding sensor 10 and the pressurizing roller 118.

In the next step S408, the detection result output from the recording sheet winding detecting circuit is checked. On this occasion, the voltage obtained by dividing the high voltage output from the high voltage power supply section 3 to the pressurizing roller 118 by the resistors 37 and 38 is inputted as the positive input to the comparator 39. The level of voltage inputted as the negative input to the comparator 39 changes depending upon whether or not the recording sheet is wound around the pressurizing roller 118.

In the case where the recording sheet is not wound around the pressurizing roller 118, the output from the comparator 39 is low since the voltage obtained by dividing the potential on the surface of the pressurizing roller 118 by the resistors 35 and 36 is inputted as the negative input to the comparator 39. In this case, the application of the high voltage output from the high voltage power supply section 3 to the pressurizing roller 118 is stopped in a step S409, and the main motor 136 is driven in a step S410 to start a predetermined process required at the start of printing.

On the other hand, in the case where the recording sheet is wound around the pressurizing roller 118, the resistance of the recording sheet wound around the pressurizing roller 118 causes a decrease in the output voltage from the winding sensor 10. Therefore, a lower voltage is inputted as the negative input to the comparator 3 than the positive input thereof, and thus, the output voltage from the comparator 39 is high. In this case, the application of the high voltage output from the high voltage power supply section 3 to the pressurizing roller 118 is stopped in the step S411, and it is determined in the step S412 that the winding of the recording sheet around the pressurizing roller 118 has occurred. The subsequent printing process is not carried out.

Warning information indicating that the recording sheet is wound around the pressurizing roller 118 is displayed on a display section, not shown, of the image forming apparatus, or is transmitted from the image forming apparatus to the external device 128 such as a personal computer via the interface 138. Alternatively to or in addition to the display of the warning information on the display section of the image forming apparatus, a sound may be emitted to warn that the recording sheet is wound around the pressurizing roller 118.

Incidentally, an image forming apparatus is known which detects the winding of the recording sheet around a roller member such as a fixing roller or a pressurizing roller at an early stage to reduce the burden of a process to be executed following the winding of the recording sheet.

For example, Japanese Laid-Open Patent Publication (Kokai) No. 2000-255835 discloses an image forming apparatus having a detecting device that brings a roller into contact with electrodes to measure the resistance values of the surface of the roller and the electrodes to thus detect the presence of a recording sheet between the roller and the electrodes.

The above publication, however, does not mention the application of a high voltage to the roller in order to prevent electrostatic offsetting as is the case with the first embodiment of the present invention. Further, the image forming apparatus disclosed in the above publication encounters a problem of false detection in the case where the detecting device that detects the winding of a recording sheet malfunctions, because there is not provided any means for detecting the malfunctioning of the detecting device.

In contrast, the image forming apparatus according to the first embodiment of the present invention is comprised of the pressurizing roller 118 that is a conductive member having an electrically conductive surface, the feeding brushes 11 as the feeding members disposed in contact with the surface of the pressurizing roller 118, the high voltage power supply section 3 serving as feeding means for applying voltage to the feeding brushes 11, the winding sensor 10 as a conductive member that is disposed in contact with the surface of the pressurizing roller 118 and located in the sheet passing area, and the CPU 5 that provides control such that the pressurizing roller 118 is inhibited from being driven when determining that the recording sheet is caught between the pressurizing roller 118 and the winding sensor 10 according the result of comparison between the detected voltage from the winding sensor 10 and the detected voltage of the feeding brushes 11.

According to the first embodiment, the high voltage power supply section 3 applies voltage to the pressurizing roller 118 to prevent the electrostatic offsetting, and the winding of the recording sheet around the pressurizing roller 118 is detected without fail. Therefore, even if the power supply of the image forming apparatus is turned on/off while the recording sheet is wound around the pressurizing roller 118, the recording sheet can be reliably prevented from being further wound around the pressurizing roller 118.

Further, according to the first embodiment, the electromagnetic solenoid 75 is provided which holds the winding sensor 10 in contact or non-contact with the sheet passing area on the surface of the pressurizing roller 118. By checking the output from the recording sheet winding detecting circuit while the winding sensor 10 is held in non-contact with the pressurizing roller 118, it is possible to detect whether or not the recording sheet winding detecting circuit is malfunctioning or not to thereby prevent false detection as to whether the recording sheet is wound around the pressurizing roller or not.

A second embodiment of the present invention will now be described in detail with reference to the drawings.

The internal construction of an image forming apparatus (laser beam printer) (refer to FIG. 1) according to the second embodiment, the arrangement of the winding sensor 10 and its related parts around the pressurizing roller 118 (refer to FIG. 2), the configuration of the recording sheet winding detecting circuit (refer to FIG. 3), and the construction of the separation mechanism of the winding sensor 10 (refer to FIG. 6A and FIG. 6B) are identical with those of the first embodiment, and therefore a description thereof is omitted herein.

The second embodiment is identical with the first embodiment except for the manner of processing in the case where the recording sheet winding detecting circuit is detected as malfunctioning when the output from the winding sensor 10 is checked while the winding sensor 10 is located apart from the pressurizing roller 118.

Referring next to flow charts of FIGS. 7 and 8, a description will be given of a recording sheet winding detecting circuit condition checking process that is carried out by the image forming apparatus according to the second embodiment, which is constructed as described above. The CPU 5 of the printer control section 4 carries out the flow of operations described with reference to the flow charts of FIGS. 7 and 8 according to a program.

The following description focuses on differences between the second embodiment and the first embodiment. According to the second embodiment, if the recording sheet winding detecting circuit is detected as malfunctioning by checking the output from the winding sensor 10 in a step S801, the program proceeds to a step S814 wherein it is determined that the recording sheet winding detecting circuit is malfunctioning. If the recording sheet winding detecting circuit is detected as malfunctioning by checking the output from the winding sensor 10 in a step S804, the program proceeds to a step S813 wherein the application of the high voltage output from the high voltage power supply section 3 to the pressurizing roller 118 is stopped and it is then determined in the step S814 that the recording sheet winding detecting circuit is malfunctioning. The program then proceeds to a step S815 wherein the main motor 136 is driven to start the predetermined process required at the start of printing.

Further, warning information indicating that the recording sheet winding detecting circuit is malfunctioning is displayed on a display section, not shown, of the image forming apparatus, or is transmitted from the image forming apparatus to the external device 128 such as a personal computer via the interface 138. Alternatively to or in addition to the display of the warning information on the display section of the image forming apparatus, a sound may be emitted to warn that the recording sheet winding detecting circuit is malfunctioning.

As described above, according to the second embodiment of the present invention, whether the recording sheet winding detecting circuit is malfunctioning or not is detected by checking the detection result output from the recording sheet winding detecting circuit while the winding sensor is held in non-contact with the pressurizing roller. If the recording sheet winding detecting circuit is detected as malfunctioning, the warning information is given to a user to warn that the recording sheet winding detecting circuit is malfunctioning, and the main motor 136 is driven. This enables printing on the recording sheet even if the recording sheet winding detecting circuit is malfunctioning.

A third embodiment of the present invention will now be described in detail with reference to the drawings.

The internal construction of an image forming apparatus (laser beam printer) (refer to FIG. 1) according to the third embodiment, the arrangement of the winding sensor 10 and its related parts around the pressurizing roller 118 (refer to FIG. 2), the configuration of the recording sheet winding detecting circuit (refer to FIG. 3), and the construction of the separation mechanism of the winding sensor 10 (refer to FIG. 6A and FIG. 6B) are identical with those of the first embodiment, and therefore a description thereof is omitted herein.

The third embodiment is identical with the first embodiment except for the manner of processing in the case where the recording sheet winding detecting circuit is detected as malfunctioning when the output from the winding sensor 10 is checked while the winding sensor 10 is held in non-contact with the pressurizing roller 118.

Referring next to flow charts of FIGS. 9 and 10, a description will be given of a recording sheet winding detecting circuit condition checking process that is carried out by the image forming apparatus according to the third embodiment, which is constructed as described above. The CPU 5 of the printer control section 4 carries out the flow of operations described with reference to the flow charts of FIGS. 9 and 10 according to a program.

The following description focuses on differences between the third embodiment and the first embodiment. According to the third embodiment, if the recording sheet winding detecting circuit is detected as malfunctioning by checking the output from the winding sensor 10 in a step S901, the program proceeds to a step S914 wherein it is determined that the recording sheet winding detecting circuit is malfunctioning. If the recording sheet winding detecting circuit is detected as malfunctioning by checking the output from the winding sensor 10 in a step S904, the program proceeds to a step S913 wherein the application of the high voltage output from the high voltage power supply section 3 to the pressurizing roller 118 is stopped and it is then determined in the step S914 that the recording sheet winding detecting circuit is malfunctioning. The program then proceeds to a step S921 wherein the setting for processing in the case where the recording sheet winding detecting circuit is malfunctioning is read to determine what kind of setting for processing is made to cope with the malfunctioning of the recording sheet winding detecting circuit.

Here, the setting for processing in the case where the recording sheet winding detecting circuit is malfunctioning means setting for selecting the manner of processing in the case where the recording sheet winding detecting circuit is malfunctioning. The user makes the setting in advance via an operation panel, not shown, provided in the image forming apparatus, or makes the setting in advance via the external device 128 such as a personal computer which is connected to the image forming apparatus via the interface 138. There are two kinds of setting for processing in the case where the recording sheet winding detecting circuit is malfunctioning:

Setting A: to stop the main motor 136 to inhibit printing in the case where the recording sheet winding detecting circuit is detected as malfunctioning; and Setting B: to drive the main motor 136 to allow printing in the case where the recording sheet winding detecting circuit is detected as malfunctioning.

If it is determined in the step S921 that the setting for processing in the case where the recording sheet winding detecting circuit is malfunctioning is the setting A, the program is terminated without driving the main motor 136. If it is determined in the step S921 that the setting for processing in the case where the recording sheet winding detecting circuit is malfunctioning is the setting B, in a step S915 the main motor 136 is driven to start the predetermined process required at the start of printing.

In the case of the setting A, warning information indicating that the recording sheet winding detecting circuit is malfunctioning is displayed on a display section, not shown, of the image forming apparatus, or is transmitted from the image forming apparatus to the external device 128 such as a personal computer via the interface 138. Likewise, in the case of the setting B, warning information indicating that the recording sheet winding detecting circuit is malfunctioning is displayed on the display section, not shown, of the image forming apparatus, or is transmitted from the image forming apparatus to the external device 128 such as a personal computer via the interface 138. In either case, alternatively to or in addition to the display of the warning information on the display section of the image forming apparatus, a sound may be emitted to warn that the recording sheet winding detecting circuit is malfunctioning.

As described above, according to the third embodiment of the present invention, whether the recording sheet winding detecting circuit is malfunctioning or not is detected by checking the detection result output from the recording sheet winding detecting circuit while the winding sensor is held in non-contact with the pressurizing roller, and it is possible to determine in advance whether the main motor is to be stopped or driven in the case where the recording sheet winding detecting circuit is detected as malfunctioning. As a result, the detection of winding of the recording sheet around the pressurizing roller carried out in a manner according to the usage by a user.

Although the above described first to third embodiments are directed to the detection of winding of the recording sheet around the pressurizing roller 118 in the image forming apparatus, this is not limitative, but the present invention may be applied to detection as to whether or not the recording sheet is wound around the fixing roller 117. In this case, the winding sensor 10 and its related parts in FIG. 2 are also provided at the fixing roller 117 so as to detect whether or not the recording sheet is wound around the fixing roller 117.

Although the above described first to third embodiments are directed to the detection of winding of the recording sheet in an image forming apparatus that is connected to an external device such as a personal computer via an interface, this is not limitative, but the detection of winding of the recording sheet the roller may be carried out in a system in which an arbitrary number of image forming apparatuses and an arbitrary number of external devices such as personal computers are connected to each other via a network.

Although the above described first and second embodiments are directed to the detection of winding of recording sheet in an image forming apparatus for example, this is not limitative, but the present invention may be applied, for example, to detection of winding of recording sheet around a roller in an image forming section of a copying machine having an image reading function and an image forming function, and detection of recording sheet around a roller in an image forming section of a composite machine (multifunction peripheral; MFP) having a plurality of functions such as an image reading function, an image forming function, and a facsimile function.

Further, the present invention should not be limited to the detection of winding of recording sheet around a roller in an image forming section such as a fixing section. For example, the present invention may be applied to ordinary conveying means for conveying a sheet, such as original conveying means in an image reading section of a copying machine, and the conveying means may be not only a roller but also a belt or the like.

It should be noted that the present invention may either be applied to a system composed of a plurality of apparatuses or to a single apparatus. Moreover, it goes without saying that the objects of the present invention can also be achieved by supplying a system or an apparatus with a storage medium storing program code of a software program that realizes the functions of the embodiments described above, and then causing a computer (or CPU, MPU or the like) of the system or apparatus to read and execute the program code stored on the storage medium.

In this case, the program code itself read from the storage medium realizes the functions of the embodiments described above, and hence the storage medium on which the program code is stored constitutes the present invention. Examples of the storage medium for supplying the program code include a floppy disk, a hard disk, an optical disk, a magnetic-optical disk, a CD-ROM, a CD-R, a magnetic tape, a nonvolatile memory card, and a ROM. Alternatively, the program code may be downloaded from a network.

Moreover, it also goes without saying that the functions of the embodiments described above may be realized not necessarily by causing the computer to read and execute the program code, but alternatively by causing an operating system (OS) running on the computer to perform part or all of the actual processing based on instructions in the program code.

Furthermore, it also goes without saying that the functions of the embodiments described above may be realized by writing the program code read from the storage medium into a memory provided on a function expansion board inserted into the computer or in a function expansion unit connected to the computer, and then causing a CPU or the like provided on the function expansion board or in the function expansion unit to perform part or all of the actual processing based on instructions in the program code.

What is claimed is:

1. A sheet winding detecting device comprising:

conveying means for conveying a sheet while rotating;

voltage applying means for applying voltage to said conveying means;

voltage detecting means for detecting voltage related to said conveying means;

sheet winding detecting means for detecting whether the sheet is wound around said conveying means according to the voltage detected by said voltage detecting means; and function status detecting means for detecting whether said sheet winding detecting means is malfunctioning, wherein when said function status detecting means detects that said sheet winding detecting means is not malfunctioning, said voltage applying means applies voltage to said conveying means, and said sheet winding detecting means detects whether the sheet is wound around said conveying means according to the voltage applied by said voltage applying means and the detected voltage, wherein when said function status detecting means detects that said sheet winding detecting means is malfunctioning, said voltage applying means omits to apply voltage to said conveying means.

2. A sheet winding detecting device according to claim 1, comprising control means for controlling said conveying means, and wherein said control means controls said conveying means such that the sheet is inhibited from being conveyed when said function status detecting means detects that said sheet winding detecting means is malfunctioning.

3. A sheet winding detecting device according to claim 1, comprising control means for controlling said conveying means, and wherein said control means controls said conveying means such that the sheet is allowed to be conveyed when said function status detecting means detects that said sheet winding detecting means is malfunctioning.

4. A sheet winding detecting device according to claim 1, comprising control means for controlling said conveying means, and setting means for setting the sheet to be conveyed or to be inhibited from being conveyed when said function status detecting means detects that said sheet winding detecting means is malfunctioning, and wherein said control means controls said conveying means according to the setting by said setting means when said function status detecting means detects that said sheet winding detecting means is malfunctioning.

5. A sheet winding detecting device according to claim 1, further comprising control means for controlling said conveying means, and wherein said control means controls said conveying means such that the sheet is inhibited from being conveyed when said sheet winding detecting means detects that the sheet is wound around said conveying means.

6. A sheet winding detecting device according to claim 1, wherein said conveying means has a pair of rollers that convey the sheet interposed therebetween, and wherein said sheet winding detecting means detects whether the sheet is wound around at least one of said rollers.

7. A sheet winding detecting device comprising:

conveying means for conveying a sheet while rotating;

voltage applying means for applying voltage to said conveying means;

voltage detecting means for detecting voltage related to said conveying means;

sheet winding detecting means for detecting whether the sheet is wound around said conveying means according to the voltage detected by said voltage detecting means; and function status detecting means for detecting whether said sheet winding detecting means is malfunctioning, wherein said function status detecting means is responsive to turning-on of power supply of said sheet winding detecting device, for detecting whether said sheet winding detecting means is malfunctioning.

8. A sheet winding detecting device according to claim 7, further comprising control means for controlling said conveying means, and wherein said control means controls said conveying means such that the sheet is inhibited from being conveyed when said function status detecting means detects that said winding detecting means is malfunctioning.

9. A sheet winding detecting device according to claim 7, further comprising control means for controlling said conveying means, and wherein said control means controls said conveying means such that the sheet is inhibited from being conveyed when said sheet winding detecting means detects that the sheet is wound around said conveying means.

10. An image forming apparatus comprising:

conveying means for conveying the recording sheet while rotating, said conveying means having a sheet passing area;

voltage applying means for applying voltage to said conveying means;

a conductive member disposed in the sheet passing area of said conveying means;

voltage detecting means for detecting voltage related to said conveying means via said conductive member;

holding means for holding said conductive member in contact or non-contact with the sheet passing area of said conveying means;

recording sheet winding detecting means for detecting whether the recording sheet is wound around said conveying means according to the voltage applied by said voltage applying means and the voltage detected by said voltage detecting means when said conductive member is held in contact with the sheet passing area of said conveying means; and function status detecting means for detecting whether said recording sheet winding detecting means is malfunctioning, wherein said function status detecting means detects whether said recording sheet winding detecting means is malfunctioning when said holding means holds the conductive member in non-contact with the sheet passing area of said conveying means.

11. An image forming apparatus according to claim 10, wherein said voltage applying means stops application of voltage when said holding means is switched between a state in which said conductive member is in contact with the sheet passing area of said conveying means and a state in which said conductive member is in non-contact with the sheet passing area of said conveying means.

12. An image forming apparatus according to claim 10, further comprising control means for controlling said conveying means, and wherein said control means controls said conveying means such that the sheet is inhibited from being conveyed when said function status detecting means detects that said sheet winding detecting means is malfunctioning.

13. An image forming apparatus according to claim 10, further comprising control means for controlling said conveying means, and wherein said control means controls said conveying means such that the sheet is inhibited from being conveyed when said sheet winding detecting means detects that the sheet is wound around said conveying means.

14. An image forming apparatus comprising:

conveying means for conveying the recording sheet while rotating, said conveying means having a sheet passing area;

voltage applying means for applying voltage to said conveying means;

a conductive member disposed in the sheet passing area of said conveying means;

voltage detecting means for detecting voltage related to said conveying means via said conductive member;

holding means for holding said conductive member in contact or non-contact with the sheet passing area of said conveying means;

recording sheet winding detecting means for detecting whether the recording sheet is wound around said conveying means according to the voltage applied by said voltage applying means and the voltage detected by said voltage detecting means when said conductive member is held in contact with the sheet passing area of said conveying means;

function status detecting means for detecting whether said recording sheet winding detecting means is malfunctioning; and control means for controlling said conveying means, and wherein said control means controls said conveying means such that the recording sheet is inhibited from being conveyed when said recording sheet winding detecting means detects that the recording sheet is wound around said conveying means, wherein said control means controls said conveying means such that the recording sheet is inhibited from being conveyed when said function status detecting means detects that said recording sheet winding detecting means is malfunctioning.

15. An image forming apparatus that forms an image on a recording sheet, comprising:

fixing means for fixing a toner image formed on the recording sheet bearing the toner image while conveying the recording sheet, said fixing means having a first rotatable member having a sheet passing area and disposed in contact with a reverse side of the recording sheet bearing the toner image, and a second rotatable member disposed in contact with a side of the recording sheet bearing the toner image;

voltage applying means for applying voltage to the first rotatable member to generate an electric field that draws toner to the recording sheet;

voltage detecting means for detecting voltage related to the first rotatable member in the sheet passing area of the first rotatable member; and recording sheet winding detecting means for detecting whether the recording sheet is wound around the first rotatable member according to the voltage detected by said voltage detecting means.

16. An image forming apparatus according to claim 15, comprising control means for controlling said fixing means, and wherein said control means controls said fixing means such that the recording sheet is inhibited from being conveyed when said recording sheet winding detecting means detects that the recording sheet is wound around the first rotatable member.

17. An image forming apparatus according to claim 15, wherein said recording sheet winding detecting means is responsive to turning-on power supply of said image forming apparatus, for detecting whether the recording sheet is wound around the first rotatable member.

18. An image forming apparatus according to claim 17, further comprising control means for controlling said conveying means, and wherein said control means controls said conveying means such that the sheet is inhibited from being conveyed when said sheet winding detecting means detects that the sheet is wound around said conveying means.

19. An image forming apparatus according to claim 17, further comprising:

a conductive member disposed in the sheet passing area of said conveying means; and holding means for holding said conductive member in contact or non-contact with the sheet passing area of said conveying means, wherein said recording sheet winding detecting means detects whether the recording sheet is wound around said conveying means according to the voltage applied by said voltage applying means and the voltage detected by said voltage detecting means when said conductive member is held in contact with the sheet passing area of said conveying means.

20. An image forming apparatus according to claim 19, wherein said voltage applying means stops application of voltage when said holding means is switched between a state in which said conductive member is in contact with the sheet passing area of said conveying means and a state in which said conductive member is in non-contact with the sheet passing area of said conveying means.

21. An image forming apparatus according to claim 15, further comprising:

a conductive member disposed in the sheet passing area of said conveying means; and holding means for holding said conductive member in contact or non-contact with the sheet passing area of said conveying means, wherein said recording sheet winding detecting means detects whether the recording sheet is wound around said conveying means according to the voltage applied by said voltage applying means and the voltage detected by said voltage detecting means when said conductive member is held in contact with the sheet passing area of said conveying means.

22. An image forming apparatus according to claim 21, wherein said voltage applying means stops application of voltage when said holding means is switched between a state in which said conductive member is in contact with the sheet passing area of said conveying means and a state in which said conductive member is in non-contact with the sheet passing area of said conveying means.

* * * * *

UNITED STATES PATENT AND TRADEMARK OFFICE

CERTIFICATE OF CORRECTION

PATENT NO. : 6,744,993 B2
DATED : June 1, 2004
INVENTOR(S) : Hiroshi Takami

It is certified that error appears in the above-identified patent and that said Letters Patent is hereby corrected as shown below:

Title page,
Item [57], ABSTRACT,
Line 15, "according" should read -- according to --.

Column 5,
Line 40, "voltage" should read -- voltage to --.

Column 6,
Line 60, "convents" should read -- converts --.

Column 8,
Line 29, "gives an adversary" should read -- has an adverse --.

Column 11,
Line 45, "according" should read -- according to --.

Signed and Sealed this

Twenty-fourth Day of August, 2004

JON W. DUDAS
*Director of the United States Patent and Trademark Office*